US008016612B2

(12) United States Patent
Burris et al.

(10) Patent No.: US 8,016,612 B2
(45) Date of Patent: Sep. 13, 2011

(54) LOCKING RATCHETING TORQUE AID

(75) Inventors: Donald Andrew Burris, Peoria, AZ (US); William Bernard Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 19 days.

(21) Appl. No.: 12/604,020

(22) Filed: Oct. 22, 2009

(65) Prior Publication Data

US 2011/0097928 A1 Apr. 28, 2011

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS

| | | | | | |
|---|---|---|---|---|---|
| 3,519,979 | A | * | 7/1970 | Bodenstein | 439/133 |
| 3,861,770 | A | * | 1/1975 | Horak | 439/133 |
| 4,053,195 | A | * | 10/1977 | Laverick et al. | 439/308 |
| 4,168,921 | A | * | 9/1979 | Blanchard | 403/19 |
| 4,285,564 | A | | 8/1981 | Spinner | 339/89 |
| 4,457,572 | A | | 7/1984 | Frazier et al. | 339/89 |
| 4,468,077 | A | | 8/1984 | Brush, Sr. et al. | 339/89 |
| 4,645,281 | A | * | 2/1987 | Burger | 439/133 |
| 4,749,251 | A | | 6/1988 | Moulin | 350/96.2 |
| 4,834,675 | A | | 5/1989 | Samchisen | 439/578 |
| 5,192,219 | A | | 3/1993 | Fowler et al. | 439/321 |
| 5,297,458 | A | * | 3/1994 | Smith et al. | 81/124.3 |
| 5,316,348 | A | * | 5/1994 | Franklin | 285/39 |
| 5,367,925 | A | * | 11/1994 | Gasparre | 81/121.1 |
| 5,470,257 | A | | 11/1995 | Szegda | 439/578 |
| 5,564,938 | A | * | 10/1996 | Shenkal et al. | 439/301 |
| 5,857,711 | A | * | 1/1999 | Comin-DuMong et al. | 285/38 |
| 5,997,350 | A | | 12/1999 | Burris et al. | 439/585 |
| 6,135,800 | A | | 10/2000 | Majors | 439/321 |
| 6,153,830 | A | | 11/2000 | Montena | 174/88 C |
| 6,716,062 | B1 | | 4/2004 | Palinkas et al. | 439/578 |
| 6,790,081 | B2 | | 9/2004 | Burris et al. | 439/578 |
| 6,817,272 | B2 | * | 11/2004 | Holland | 81/124.2 |
| 7,021,947 | B1 | * | 4/2006 | Purdy | 439/133 |
| 7,033,195 | B2 | * | 4/2006 | Murphy et al. | 439/307 |
| 7,080,581 | B2 | * | 7/2006 | Reese | 81/475 |
| 7,128,605 | B2 | * | 10/2006 | Montena | 439/578 |
| 7,147,509 | B1 | * | 12/2006 | Burris et al. | 439/578 |
| 7,179,100 | B2 | * | 2/2007 | Montena | 439/133 |
| 7,181,999 | B1 | * | 2/2007 | Skeels et al. | 81/124.2 |
| 7,182,639 | B2 | | 2/2007 | Burris | 439/584 |
| 7,281,947 | B2 | * | 10/2007 | Pescatore | 439/578 |
| 7,347,129 | B1 | * | 3/2008 | Youtsey | 81/467 |
| 7,618,276 | B2 | * | 11/2009 | Paglia et al. | 439/322 |
| 7,837,501 | B2 | * | 11/2010 | Youtsey | 439/578 |
| 2004/0194585 | A1 | * | 10/2004 | Clark | 81/124.2 |
| 2006/0172579 | A1 | * | 8/2006 | Murphy et al. | 439/307 |
| 2009/0053930 | A1 | * | 2/2009 | Burris et al. | 439/578 |

FOREIGN PATENT DOCUMENTS

| | | |
|---|---|---|
| EP | 0644625 | 4/1994 |
| WO | 99/41808 | 8/1999 |

* cited by examiner

*Primary Examiner* — Ross N Gushi
(74) *Attorney, Agent, or Firm* — Matthew J. Mason

(57) ABSTRACT

A torque aid for a coaxial connector is provided. The torque aid has a tubular grip element and a locking mechanism. The locking mechanism is moveable from a first position to a second position. When the locking mechanism is in the first position, rotation of the torque aid is inhibited in at least one direction. When the locking mechanism is in the second position, the torque aid is rotatable in either the clockwise or counterclockwise direction.

13 Claims, 9 Drawing Sheets

LOCKING RATCHETING TORQUE AID

BACKGROUND

The disclosure relates generally to coaxial cable connectors, and particularly to a gripping aid for allowing a technician to tighten a coaxial connector to an equipment port while providing a mechanism to prevent or limit connector loosening.

Coaxial cable connectors, such as Type F connectors, are used to attach a coaxial cable to another object such as an appliance or junction having a terminal, or port, adapted to engage the connector. Such connectors are typically attached to the end of a coaxial cable using various cable preparation techniques and installation tools. Many of these connectors are compressed axially to complete the attachment process, and are hence known as "compression connectors." Once compressed onto the end of a coaxial cable, the connector is attached to various equipment ports. Often these ports are incorporated into somewhat fragile equipment, such as a DVD player or television set. Due to the sensitive nature of equipment of this type, field installers are hesitant to use a wrench to tighten a coaxial cable connector onto a port of such equipment. Additionally, consumers often disconnect coaxial cables from equipment when relocating such equipment, but consumers are usually not adequately trained or equipped to properly reconnect such coaxial connectors to the equipment ports following such relocation. Accordingly, the connectors may not be sufficiently tightened, and poor picture quality often results, whereupon the CATV system operator is obliged to send out a qualified field technician to address the issue, resulting in what is known in the industry as a "truck roll." Truck rolls and related service calls burden CATV system operators in terms of both finance and customer satisfaction and are to be avoided as much as possible.

In the past, others have attempted to provide a coaxial connector assembly which avoids the need for wrenches or other installation tools when tightening the coaxial connector to an equipment port. For example, Ben Hughes Communication Products Company, doing business as CablePrep, offers a torque wrench product sold under the trademark "Wing Ding." These and similar products are formed of plastic, are installed over an F-style coaxial connector, and include a pair of opposing wings for allowing a user greater leverage when hand-tightening the coupling nut of a coaxial connector as compared with directly grasping the coupling nut itself However, considerable manipulation is often required to install such devices onto the coaxial connector and the coupling nut. In addition, torque wrenches intended to be used with such products typically provide only a relatively short area for fingers to grip. A short gripping area makes it difficult to access and rotate the coupling nut of the coaxial connector when the connector is installed in a recess formed in the back of a television or other video equipment, as is often the case.

Other attempts to produce a more easily grasped connector have resulted in special connectors with grip aids built in. For example, U.S. Pat. No. 6,716,062 to Palinkas, et al., discloses an F-type connector wherein the coupling nut includes a cylindrical outer skirt of constant outer diameter and a knurled gripping surface. Likewise, Visicom of Australia offers a series of RF connectors that include an elongated coupling nut having a knurled outer surface for better gripping.

While at least some of the above noted approaches may serve to provide a means for improved torquing of connectors with bare finger pressure, they typically fail to provide a means to lock the connector coupler in position and fail to prevent or limit accidental or incidental loosing of the connected joint.

SUMMARY

One embodiment includes a torque aid for tightening a coaxial connector to an equipment port. The coaxial connector includes a body having a front end and a back end. The connector also includes a coupler rotatably attached to the front end of the body. The torque aid includes a tubular grip element having a front end, a back end, and an internal bore extending therethrough along an axial length thereof The front end of the tubular grip element has an internal surface that is configured to engage the outer surface of the coupler. The torque aid also includes a locking mechanism that is movable from a first position to a second position. The torque aid is configured to be placed over the connector such that when the locking mechanism in the first position, rotation of the torque aid and the coupling nut is inhibited in at least one direction. In addition, the torque aid is configured to be placed over the connector such that when the locking mechanism is in the second position, the torque aid and the coupling nut are rotatable in either the clockwise or counterclockwise direction until the coaxial connector is fully tightened to the equipment port.

Another embodiment includes a combination of a coaxial connector and a torque aid for tightening the coaxial connector to an equipment port. The coaxial connector includes a body having a front end and a back end. The coaxial connector also includes a coupler rotatably attached to the front end of the body. The torque aid includes a tubular grip element having a front end, a back end, and an internal bore extending therethrough along an axial length thereof The front end of the tubular grip element has an internal surface that engages the outer surface of the coupler. The torque aid also includes a locking mechanism moveable from a first position to a second position. The torque aid is placed over the connector such that when the locking mechanism in the first position, rotation of the torque aid and the coupling nut is inhibited in at least one direction. In addition, when the locking mechanism is in the second position, the torque aid and the coupling nut are rotatable in either the clockwise or counterclockwise direction until the coaxial connector is fully tightened to the equipment port.

Yet another embodiment includes a torque aid for tightening a coaxial connector to an equipment port. The coaxial connector includes a body having a front end and a back end. The torque aid includes a coupling grip element having a front end, a back end, and an internal bore extending therethrough along an axial length thereof The front end of the coupling grip element has an internal surface that is configured to engage the outer surface of the equipment port. The torque aid also includes a locking mechanism moveable from a first position to a second position. The torque aid is configured to be placed over the connector such that when the locking mechanism in the first position, rotation of the torque aid is inhibited in at least one direction. In addition, the torque aid is configured to be placed over the connector such that when the locking mechanism is in the second position, the torque aid is rotatable in either the clockwise or counterclockwise direction until the coaxial connector is fully tightened to the equipment port.

One or more embodiments disclosed herein can provide advantages that include a coaxial connector that can be easily, quickly, and reliably installed by hand over an equipment port and a torque aid for such a coaxial connector that is relatively inexpensive and easily utilized, for example, specifically allowing the coupling nut of a coaxial connector to be more easily grasped. Such embodiments can include a torque aid that facilitates tightening of the coupling nut of a coaxial connector when the coaxial connector is coupled with an equipment port that is located in a recessed area of a television set or other electronic equipment. Such embodiments can also include a torque aid that includes a mechanism for locking the connector coupler in position to prevent or limit accidental or incidental loosing of the connected joint. In addition, such embodiments can include a torque aid that engages a connector body element using a ratchet-type engagement mechanism allowing rotation in one direction while preventing or limiting rotation in an opposite direction until the ratchet-type mechanism is released or overcome.

Additional features and advantages will be set forth in the detailed description which follows, and in part will be readily apparent to those skilled in the art from that description or recognized by practicing the embodiments as described herein, including the detailed description which follows, the claims, as well as the appended drawings.

It is to be understood that both the foregoing general description and the following detailed description present exemplary embodiments, and are intended to provide an overview or framework for understanding the nature and character of the claims. The accompanying drawings are included to provide a further understanding, and are incorporated into and constitute a part of this specification. The drawings illustrate various embodiments, and together with the description serve to explain the principles and operations of the various embodiments.

DETAILED DESCRIPTION

Reference will now be made in detail to the present preferred embodiments, examples of which are illustrated in the accompanying drawings.

FIGS. 1-4 illustrate a first embodiment of a ratcheting torque aid 1000 and coaxial connector 6000, wherein coaxial connector is connected to cable 100. Coaxial connector 6000 includes body 4000 having a front end 4010 and a back end 4020. Coaxial connector 6000 also includes a coupler 2000 rotatably attached to the front end 4010 of body 4000. Ratcheting torque aid includes tubular grip element 3000. Tubular grip element 3000 is preferably of unitary construction and is preferably made of plastic and may be molded or machined to shape. In preferred embodiments, tubular grip element 3000 is made from Acetal plastic material. Acetal is a crystalline thermoplastic polymer with a high melting point, and a high modulus of elasticity. Acetal plastic material provides good strength, stiffness, resistance to abrasion, dimensional stability, and resistance to moisture. A homopolymer form of Acetal resin is commercially available under the registered trademark DELRIN® from E. I. duPont de Nemours & Co. of Wilmington, Del. and its distributors. In preferred embodiments, a preferred manufacturing method of tubular grip element 3000 includes injection molding of the Acetal plastic resin.

Figure 2:
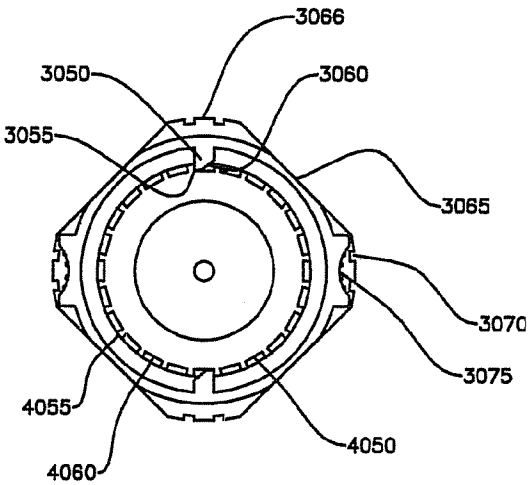
FIG. 2 illustrates a perspective end view of the embodiment illustrated in FIG. 1, showing locking and ratcheting elements in an engaged state.

Tubular grip element 3000 has a front end 3010, a back or distal end 3040, and an outer surface that includes a plurality of flattened outer faces, or "flats" as shown by 3065 in FIG. 2. Within the end view shown in FIG. 2, it will be seen that the flats 3065 are joined by rounded corner portions 3066. Within the end view shown in FIG. 2, and also the view shown in FIG. 3, tubular grip element 3000 further includes a set of longitudinal grooves 3070 and a set of longitudinal ridges 3075 on curved outer surface 3210 of pads 3200 to improve grip. The outer surface of tubular grip element 3000 is configured and dimensioned so that it will fit into the compression chamber of an industry-standard coaxial connector axial compression tool, such as the TerminX® Series of axial compression tool sold by Ben Hughes Communication Products Company, doing business as CablePrep, of Chester, Conn.

Tubular grip element 3000 has an internal bore 3020 extending therethrough along the axial length thereof Front end 3010 of tubular grip element 3000 has an internal surface that is configured to engage the outer surface of the coupler. Preferably, one end of internal bore 3020 is formed to have a hexagonal shape 3085 to engage coupler flats 2010.

Torque aid 1000 includes a locking mechanism moveable from a first position to a second position wherein the torque aid is configured to be placed over the connector such that when the locking mechanism is in the first position, rotation of the torque aid 1000 and coupling nut 2000 is inhibited in at least one direction, which is preferably a direction that would cause the connector to be loosened from an equipment port. In contrast, when the locking mechanism is in the second position, the torque aid 1000 and the coupling nut 2000 are rotatable in either the clockwise or counterclockwise direction until the coaxial connector 6000 is fully tightened to the equipment port.

FIG. 2 illustrates an embodiment of a locking mechanism in the first position wherein back or distal end 3040 has a plurality of pawls 3050 radially disposed to engage grooves 4050 that are radially spaced about body 4000. Pawls 3050 comprise sharp corner 3055 and beveled edge 3060. Beveled edge 3060 allows rotation of grip element 3000 in one direction relative to connector body 4000 while sharp corner 3055 prevents or limits rotation of grip element relative to connector body 4000 in the opposite direction. Flexible beam shape of pawls 3050 and elasticity of tubular grip element 3000 permit pawls 3050 to be driven over high points 4055 and then return to low points 4060 in body 4000 having a ratchet effect preventing or limiting unwanted rotation in one direction when locked and allowing rotation in a desired direction when un-locked. Accordingly, the locking mechanism comprises at least two pawls 3050 that extend radially inwardly from an internal surface of the torque aid 1000 wherein, when the locking mechanism is in the first position, the pawls 3050 are each configured to engage a groove 4050 on an outer surface of body 4000 in order to inhibit the rotation of the torque aid 1000 and the coupling nut 2000 in at least one direction, which is preferably a direction which would cause the connector to be loosened from the equipment port. Alternatively, connector body 4000 may be made of a multiplicity of component parts wherein some of the components slide together to activate the connector/cable clamping mechanism as illustrated in U.S. Pat. No. 7,182,639. Yet still another combination of connector components may be integrated with the present invention where a tubular member is utilized to activate the connector/cable clamping mechanism as illustrated in U.S. Pat. No. 4,834,675 and U.S. Pat. No. 5,470,257. A further alternate combination of connector components may be integrated with the present invention where an outer tubular member is utilized to deform the connector body to activate the connector/cable clamping mechanism as illustrated in U.S. Pat. No. 6,153,830 and U.S. Pat. No. 5,997,350.

Figure 4:
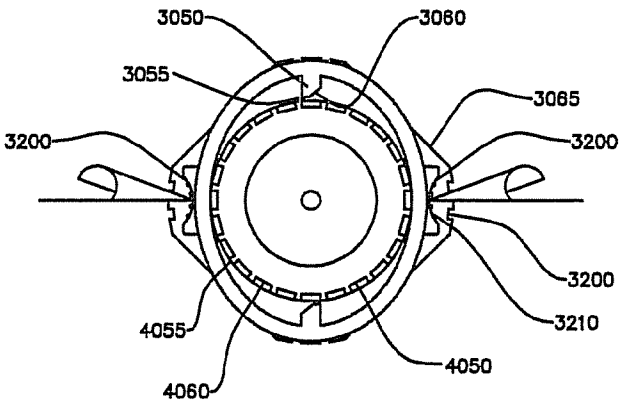
FIG. 4 illustrates a perspective end view of the embodiment illustrated in FIG. 1, showing locking and ratcheting elements in a disengaged state.
Figure 3:
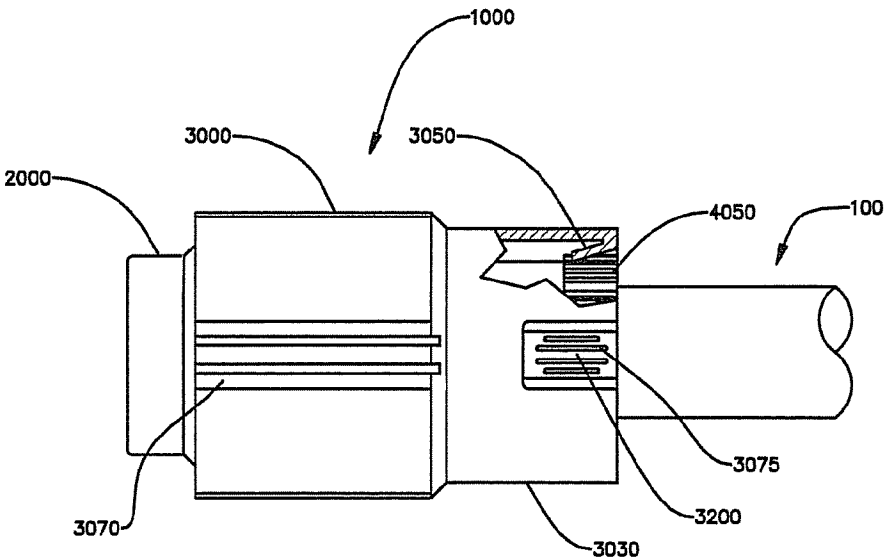
FIG. 3 illustrates a partial side cutaway view of the embodiment illustrated in FIG. 1 comprising a ratcheting locking torque aid and connector.

FIGS. 3 and 4 illustrate movement of locking mechanism from the first position to the second position, which, in the embodiment illustrated in FIGS. 1-4, involves disengagement of sharp corner 3055 from grooves 4050. Finger pressure exerted radially inwardly at pads 3200 causes extended section 3030 of tubular member 3000 to become ovaloid in shape with the lesser axis of the shape in line with pads 3200 and the greater axis perpendicular to pads 3200, coincident with pawls 3050 having the effect of radially disposing pawls 3050 away from grooves 4050. In this second position of locking mechanism, tubular member 3000 is free to rotate, driving rotation of coupler 2000. Specifically, torque aid 1000 is configured to be placed over connector 6000 such that when the locking mechanism is in the second position, an engagement between tubular grip element 3000 and the coupler 2000 drives rotation of the coupler 2000. Preferably, this engagement is between hexagonal shape 3085 of internal bore 3020 and coupler flats 2010.

Accordingly, FIGS. 3-4 illustrate that the locking mechanism is movable from the first position to the second position by applying radially inward pressure on at least two opposing sides of an outer surface of the torque aid 1000, specifically at pads 3200 on outer surface of tubular member 3000. Alternatively stated, FIGS. 3-4 illustrate that the locking mechanism comprises at least two pawls 3050 that extend radially inwardly from an internal surface of the torque aid 1000 and application of radially inward pressure on at least two opposing sides of the outer surface of the torque aid, specifically at pads 3200 on outer surface of tubular member 3000, causes radial outward movement of said at least two pawls 3050. Preferably, each pad 3200 is configured to be pressed radially inwardly at a direction that is approximately perpendicular to the radial outward movement of each pawl 3050.

Figure 5:
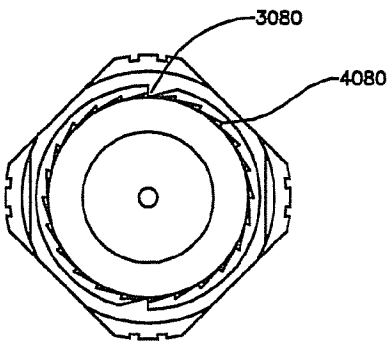
FIG. 5 illustrates a perspective end view of an alternate embodiment of a locking ratcheting torque aid, as disclosed herein, showing locking and ratcheting elements in an engaged state.

FIG. 5 illustrates an end perspective view of an alternate embodiment of a locking ratcheting torque aid, as disclosed herein, wherein the locking mechanism is in the first position, showing locking and ratcheting elements in an engaged state wherein ratchet teeth 4080 are formed in a radial saw-toothed pattern as opposed to grooves, wherein ratchet teeth 4080 are configured to engage pawls 3080.

Figure 6:
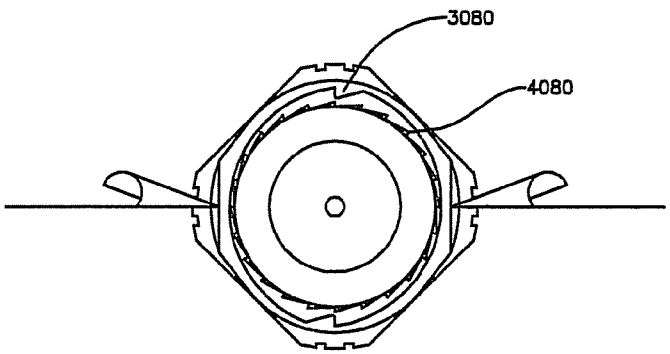
FIG. 6 illustrates a perspective end view of the embodiment illustrated in FIG. 5, showing locking and ratcheting elements in a disengaged state.

FIG. 6 illustrates a perspective view of the embodiment of a locking ratcheting torque aid illustrated in FIG. 5, wherein the locking mechanism is in the second position, showing locking and ratcheting elements in a disengaged state by applying radially inward pressure in a similar manner as described above with reference to FIGS. 3-4.

Figure 7:
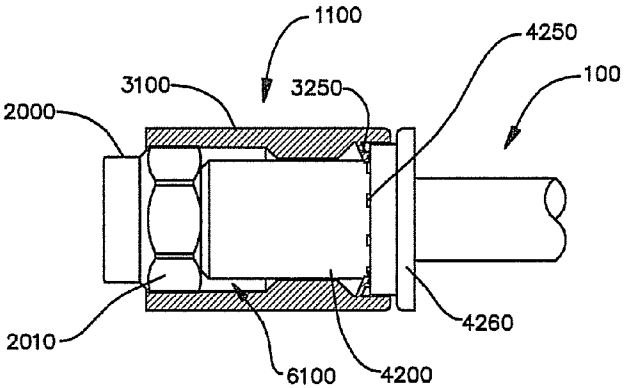
FIG. 7 illustrates a partial side cutaway view along the centerline of another alternate embodiment of a locking ratcheting torque aid, as disclosed herein, comprising a ratcheting locking torque aid and connector with the locking mechanism in an engaged state.

FIG. 7 illustrates a partial side cutaway view along the centerline of an alternate embodiment of a locking ratcheting torque aid, as disclosed herein, comprising a ratcheting locking torque aid 1100 and connector 6100 with the locking mechanism in a first position or engaged state, wherein ratcheting pawls 3250 engage a plurality of teeth 4250 disposed on outer surface of body 4200. The loaded beam design of ratcheting pawls 3250 is rearwardly disposed when tubular element 3100 is in a forward position thus locking tubular element 3100 and coupler 2000 in position. Shoulder 4260 provides a mechanical stop for tubular element 3100.

Figure 8:
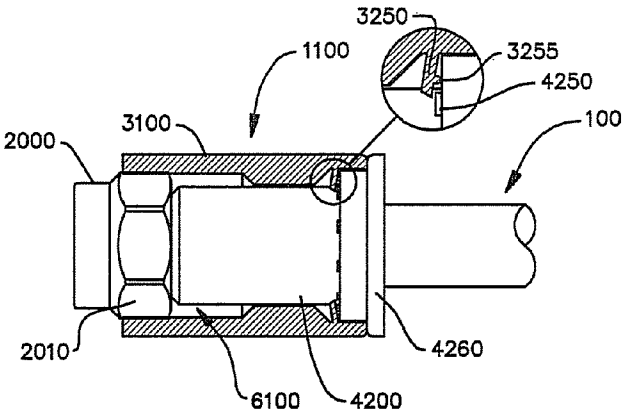
FIG. 8 illustrates a partial side cutaway view along the centerline of the embodiment illustrated in FIG. 7, comprising a ratcheting locking torque aid and connector with the locking mechanism in a disengaged state.

FIG. 8 illustrates a partial side cutaway view along the centerline of the embodiment illustrated in FIG. 7, wherein the locking mechanism has been moved to a second position by moving tubular element 3100 in a rearward axial direction. In FIG. 8, locking mechanism is shown in a disengaged state wherein movement of tubular element 3100 in rearward axial direction causes ratcheting pawls 3250 to pivot about protuberance 3255 moving the free end of ratcheting pawls 3250 away from, or disengaging them from teeth 4250. In other words, movement of the torque aid 1100 in a rearward axial direction causes at least two pawls 3250 to pivot forward. In said condition, tubular member 3100 is free to rotate, driving rotation of coupler 2000 in either the clockwise or counterclockwise direction.

Figure 9:
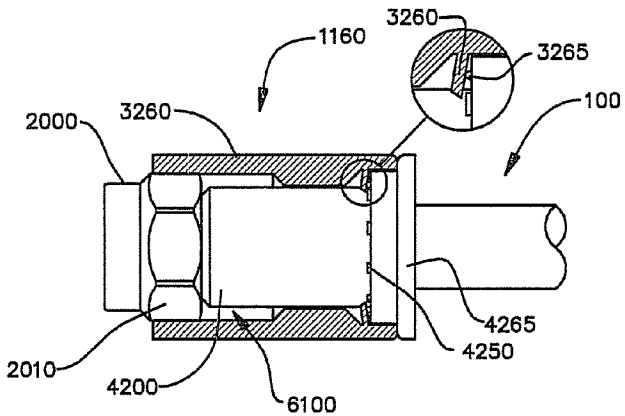
FIG. 9 illustrates a partial side cutaway view along the centerline of another alternate embodiment of a locking ratcheting torque aid, as disclosed herein, comprising a ratcheting locking torque aid and connector with the locking mechanism in a disengaged state.

FIG. 9 illustrates a partial side cutaway view along the centerline of another alternate embodiment of a locking ratcheting torque aid 1160, as disclosed herein, comprising a ratcheting locking torque aid and connector with the locking mechanism in a second position or disengaged state similar to connector 1100 depicted in FIG. 8 except protuberance 3265 is part of body member 4200 and not part of ratcheting pawl 3260. Movement of tubular element 3260 in a rearward axial direction causes ratcheting pawls 3260 to pivot about protuberance 3265 moving the free end of ratcheting pawls 3260 away from, or disengaging them from teeth 4250. Thus, similar to the embodiment illustrated in FIG. 8, movement of torque aid 1160 in a rearward axial direction causes at least two pawls 3260 to pivot forward. In said condition, tubular member is free to rotate, driving rotation of coupler 2000 in either the clockwise or counterclockwise direction. Shoulder 4265 provides mechanical stop for tubular element.

Figure 10:
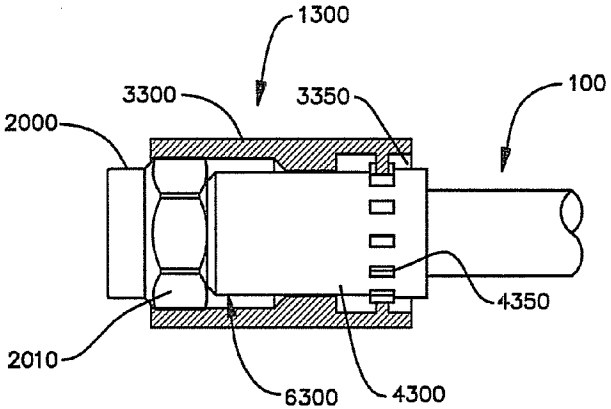
FIG. 10 illustrates a partial side cutaway view along the centerline of another alternate embodiment of a locking torque aid, as disclosed herein, comprising a ratcheting locking torque aid and connector with the locking mechanism in an engaged state.

FIG. 10 illustrates a partial side cutaway view along the centerline of an alternate embodiment of a locking torque aid, as disclosed herein, comprising a ratcheting locking torque aid 1300 and connector 6300 with the locking mechanism in a first position or engaged state, wherein a plurality of teeth 4350 are radially disposed about body 4300 in a saw tooth pattern and ratcheting pawls 3350 extend inwardly from inner surface of tubular element 3300. Alternatively stated, FIG. 10 illustrates a locking mechanism that includes at least two pawls 3350 that extend radially inwardly from an internal surface of torque aid 1300, and specifically extend radially inwardly from tubular element 3300, wherein, when the locking mechanism is in the first position, each of the pawls 3350 engages one of the plurality of teeth 4350 in order to inhibit the rotation of the torque aid 1300 and the coupling nut 2000 in at least one direction, which is preferably a direction that would cause the connector to be loosened from an equipment port.

Figure 11:
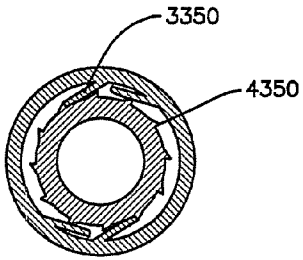
FIG. 11 illustrates a cutaway end view of the embodiment illustrated in FIG. 10, showing locking and ratcheting elements in both engaged and disengaged states.

FIG. 11 illustrates a cutaway end view of the embodiment illustrated in FIG. 10, showing locking and ratcheting elements in both engaged and disengaged states wherein ratcheting pawls 3350 are located such that they can engage teeth 4350 in alternating positions allowing half-step or finer tooth engagement, thereby further limiting to a finer degree the amount of angular displacement permitted by the locking ratcheting mechanism. In the embodiment illustrated in FIG. 11, engagement between pawls 3350 and teeth 4350 alternates between the tip of a pawl contacting the radially outermost part of a tooth and the side of an adjacent pawl contacting the radially outermost part of an adjacent tooth.

Figure 12:
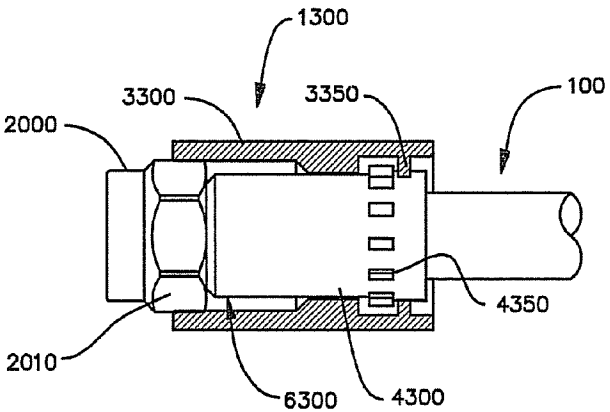
FIG. 12 illustrates a partial side cutaway view along the centerline of the embodiment illustrated in FIG. 10, comprising a ratcheting locking torque aid and connector with the locking mechanism in a disengaged state.

FIG. 12 illustrates a partial side cutaway view along the centerline of the embodiment illustrated in FIG. 10 wherein locking mechanism is in a second position or disengaged state. Rearward axial movement of tubular element 3300 causes ratcheting pawls 3350 to be axially disengaged from teeth 4350. In this second position of locking mechanism, tubular member 3300 is free to rotate, driving rotation of coupler 2000 in either the clockwise or counterclockwise direction.

Figure 13A:
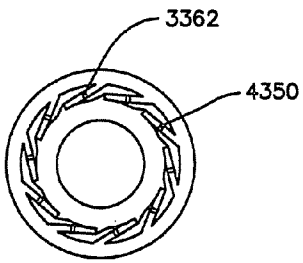
FIG. 13A illustrates a perspective end view of another alternate embodiment of a locking ratcheting torque aid, as disclosed herein, comprising an alternative configuration of locking and ratcheting elements.

FIG. 13A illustrates a perspective end view of an alternate embodiment of a locking ratcheting torque aid, as disclosed herein, comprising an optional configuration of ratcheting pawls 3362 and teeth 4350 respectively, wherein a plurality of pawls 3362 extend circumferentially around an inner surface of tubular element 3300 and a plurality of teeth 4350 extend circumferentially around an outer surface of body 4300.

Figure 13B:
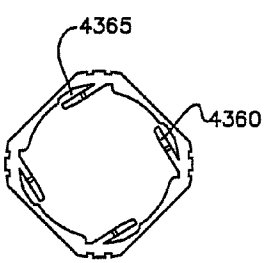
FIG. 13B illustrates a perspective end view of another alternate embodiment of a locking ratcheting torque aid, as disclosed herein, comprising another alternative configuration of locking and ratcheting elements.

FIG. 13B illustrates a perspective end view of an alternate embodiment of a locking ratcheting torque aid, as disclosed herein, comprising an optional configuration of ratcheting pawls 4360 wherein ratcheting pawls 4360 are free to move into clearance area 4365 when forced radially outwardly.

Figure 14:
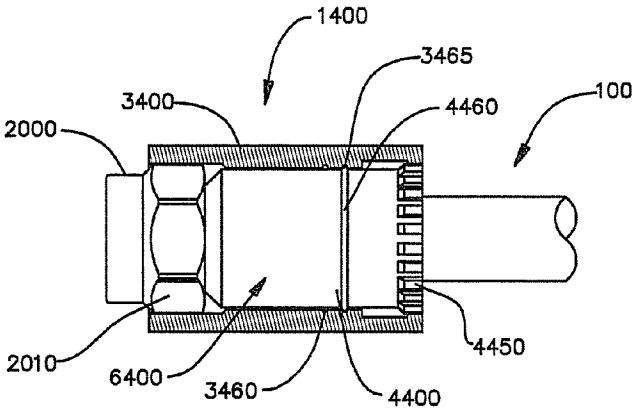
FIG. 14 illustrates a partial side cutaway view along the centerline of another alternate embodiment of a locking torque aid, as disclosed herein, comprising a connector with a locking non-ratcheting mechanism in an engaged state.

FIG. 14 illustrates a partial side cutaway view along the centerline of an alternate embodiment of a locking non-ratcheting torque aid as disclosed herein, comprising a torque aid 1400 and a connector 6400 with the locking mechanism in a first position or engaged state, wherein a plurality of internal teeth 3450 on internal surface of tubular element 3400 engage a plurality of external teeth 4450 on outer surface of body 4400 similar to that of a hub on a four-wheel drive mechanism for a motor vehicle. When tubular element 3400 is held in a locked forward position by the engagement of bump 4460 with internal groove 3465, internal teeth 3450 and external teeth 4450 are engaged in a spline-type arrangement preventing or limiting rotation of tubular element 3400 and subsequently preventing or limiting rotation of coupler 2000 in either the clockwise or counterclockwise direction.

Figure 15:
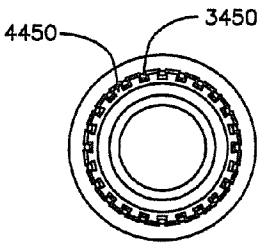
FIG. 15 illustrates a perspective end view of the embodiment illustrated in FIG. 14, showing a configuration of locking elements.

FIG. 15 illustrates a perspective end view of the embodiment illustrated in FIG. 14, showing plurality of internal teeth 3450 engaging plurality of external teeth 4450.

Figure 16:
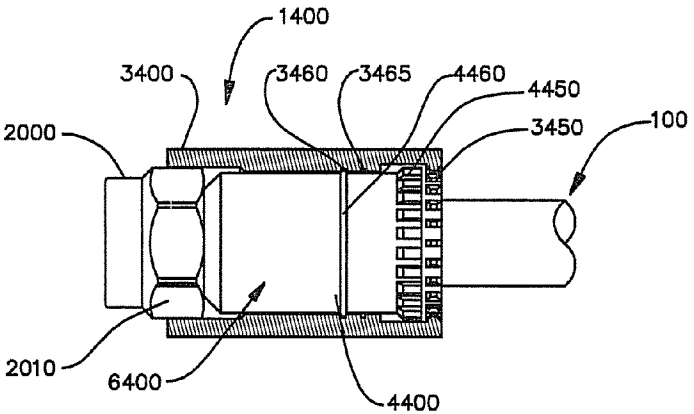
FIG. 16 illustrates a partial side cutaway view along the centerline of the embodiment illustrated in FIG. 14, comprising a connector with the locking non-ratcheting mechanism in a disengaged state.

FIG. 16 illustrates a partial side cutaway view along the centerline of the embodiment illustrated in FIG. 14, showing the locking mechanism in a second position or disengaged state, wherein the plurality of internal teeth 3450 are linearly separated from the plurality of external teeth 4450 similar to that of a hub on a four-wheel drive mechanism for a motor vehicle. When tubular element 3400 is held in an un-locked backward position by the engagement of bump 4460 with internal groove 3460 as a result of rearward axial movement of torque aid 1400 from position in which bump 4460 was engaged with internal groove 3465, internal teeth 3450 and external teeth 4450 are disengaged in a spline-type arrangement allowing rotation of tubular element 3400 and subsequently allowing rotation of coupler 2000 in either the clockwise or counterclockwise direction.

Figure 17:
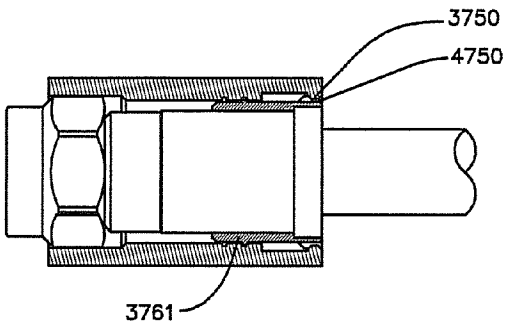
FIG. 17 illustrates a partial side cutaway view along the centerline of another alternate embodiment of a locking non-ratcheting torque aid, as disclosed herein, comprising a connector with the locking non-ratcheting mechanism constructed from an alternate configuration of multiple components.

FIG. 17 illustrates a partial side cutaway view along the centerline of an alternate embodiment of a locking non-ratcheting torque aid, as disclosed herein, comprising a connector with the locking non-ratcheting mechanism constructed from an alternate configuration of multiple components added to an existing connector body as identified in U.S. Pat. No. 6,790,081 and by Corning Gilbert UltraEase® product GF-UE-6 and acting with a similar mechanism as shown with respect to FIGS. 14-16. Tubular element in FIG. 17 is configured to be similar to tubular element 3400 shown in FIGS. 14-16. Alternate configuration of multiple components includes ring 3761 that is pressed on to outer surface of connector body, wherein internal teeth 3750 of tubular element engage external teeth 4750 of ring 3761.

Figure 18:
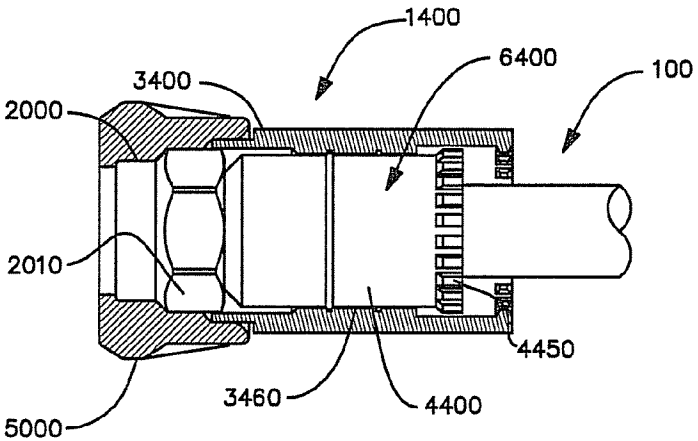
FIG. 18 illustrates a partial side cutaway view along the centerline of another alternate embodiment of a locking non-ratcheting torque aid, as disclosed herein, comprising a connector with a locking non-ratcheting mechanism in a disengaged state and further comprising an optional seal ring.

FIG. 18 illustrates a partial side cutaway view along the centerline of an alternate embodiment of a locking non-ratcheting torque aid, as disclosed herein, comprising a connector with a locking non-ratcheting mechanism in a disengaged state similar to the embodiment illustrated in FIG. 16 and further comprising an optional seal ring 5000 in an "as shipped" condition.

Figure 19:
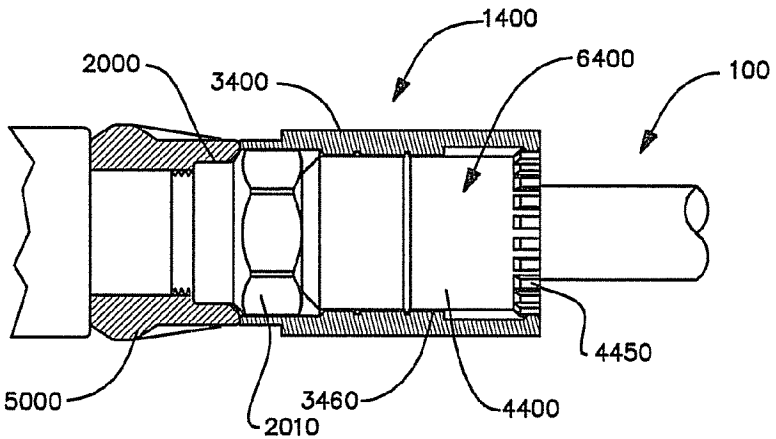
FIG. 19 illustrates a partial side cutaway view along the centerline of the embodiment illustrated in FIG. 18, comprising a connector with the locking non-ratcheting mechanism in an engaged state and further comprising an optional seal ring.

FIG. 19 illustrates a partial side cutaway view along the centerline of the embodiment illustrated in FIG. 18, comprising a connector with the locking non-ratcheting mechanism in an engaged state similar to the embodiment illustrated in FIG. 14 and further comprising an optional seal ring 5000 in a "deployed" condition.

Figure 20:
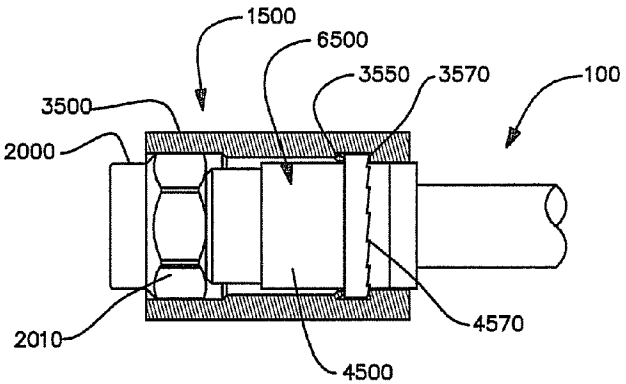
FIG. 20 illustrates a partial side cutaway view along the centerline of another alternate embodiment of a locking ratcheting torque aid, as disclosed herein, comprising a connector with the locking ratcheting mechanism in an engaged state.

FIG. 20 illustrates a partial side cutaway view along the centerline of an alternate embodiment of a locking ratcheting torque aid 1500, as disclosed herein, comprising a connector 6500 with the locking ratcheting mechanism in a first position or engaged state, wherein pawls 3570 on internal surface of tubular element 3500 are forward-facing and ratcheting teeth 4570 on outer surface of body 4500 are rearward facing. Arm 3550 acts as a spring to maintain engagement between pawls 3570 and ratcheting teeth 4570 until axial reward force on tubular member 3500 overcomes arm 3550, pushing pawls 3570 and ratcheting teeth 4570 into a second position or disengaged state.

Figure 21:
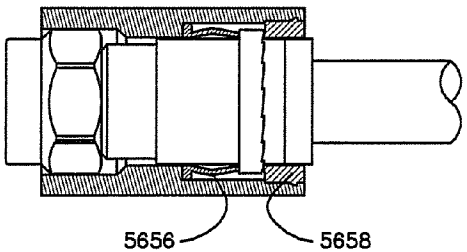
FIG. 21 illustrates a partial side cutaway view along the centerline of another alternate embodiment of a locking ratcheting torque aid, as disclosed herein, comprising a connector with the locking ratcheting mechanism in an engaged state.

FIG. 21 illustrates a partial side cutaway view along the centerline of an alternate embodiment of a locking ratcheting torque aid, as disclosed herein, comprising a connector with the locking ratcheting mechanism in a first position or engaged state. The embodiment illustrated in FIG. 21 operates in a similar manner as the embodiment illustrated in FIG. 20 but employs an alternate arm mechanism 5656 and retainer 5658. Arm mechanism 5656 acts as a spring to maintain engagement between rear retainer 5658 and ratcheting teeth.

Figure 22:
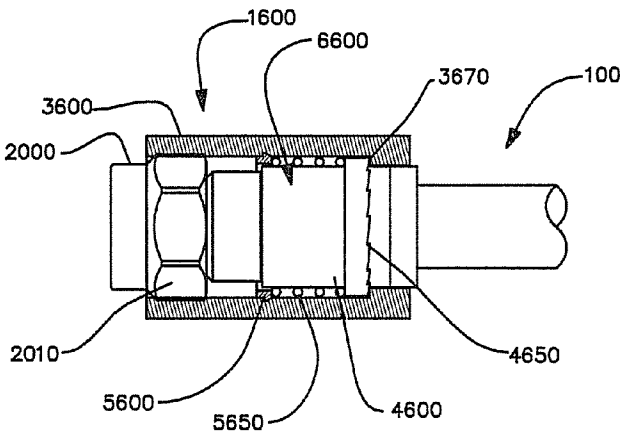
FIG. 22 illustrates a partial side cutaway view along the centerline of another alternate embodiment of a locking ratcheting torque aid, as disclosed herein, comprising a connector with the locking ratcheting mechanism in an engaged state.

FIG. 22 illustrates a partial side cutaway view along the centerline of an alternate embodiment of a locking ratcheting torque aid 1600, as disclosed herein, comprising a connector 6600 with the locking ratcheting mechanism in a first position or engaged state. The embodiment illustrated in FIG. 22 operates in a similar manner as embodiment illustrated in FIG. 20 but employs an alternate coil spring mechanism 5650 and front retainer 5600. Coil spring mechanism 5650 circumferentially surrounds body 4600 and acts to bias the locking mechanism in the first position (to maintain engagement between pawls 3670 and ratcheting teeth 4650) until axial rearward force on tubular member 3600 overcomes coil spring mechanism 5650, pushing pawls 3670 and ratcheting teeth 4650 into a second position or disengaged state.

Figure 23:
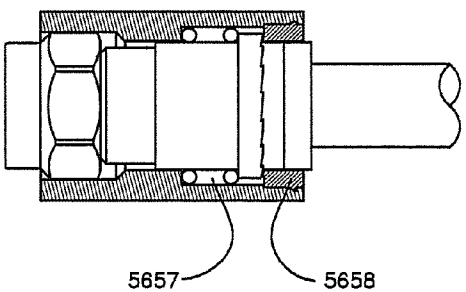
FIG. 23 illustrates a partial side cutaway view along the centerline of another alternate embodiment of a locking ratcheting torque aid, as disclosed herein, comprising a connector with the locking ratcheting mechanism in an engaged state.

FIG. 23 illustrates a partial side cutaway view along the centerline of an alternate embodiment of a locking ratcheting torque aid, as disclosed herein, comprising a connector with the locking ratcheting mechanism in a first position or engaged state. The embodiment illustrated in FIG. 23 operates in a similar manner as embodiment illustrated in FIG. 20 but employs an alternate coil spring mechanism 5657 and rear retainer 5658.

Figure 25:
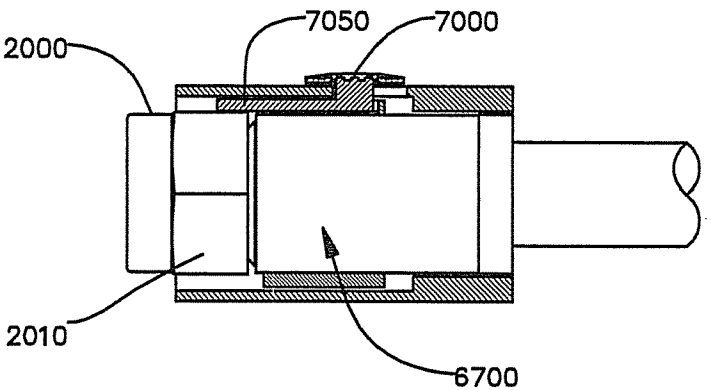
FIG. 25 illustrates a partial side cutaway view along the centerline of the embodiment illustrated in FIG. 24, comprising a connector with the locking non-ratcheting mechanism in an engaged state.
Figure 24:
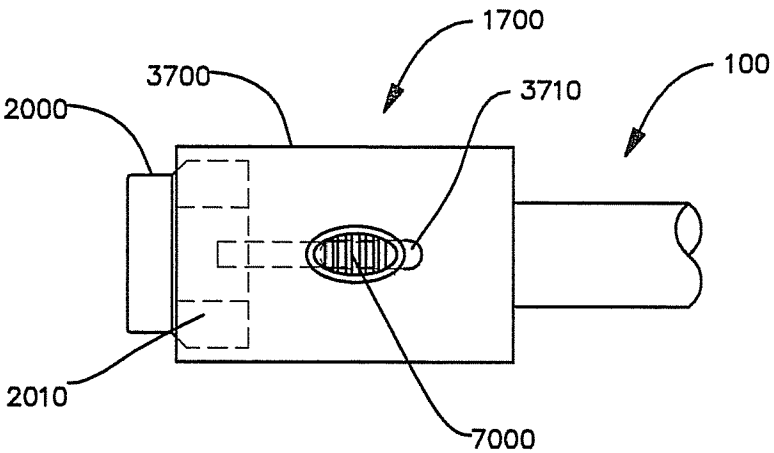
FIG. 24 illustrates a perspective view of another alternate embodiment of a locking non-ratcheting torque aid, as disclosed herein, comprising a connector with the locking non-ratcheting mechanism in an engaged state.

FIG. 24 illustrates a perspective view of an alternate embodiment of a locking non-ratcheting torque aid 1700, as disclosed herein, comprising a connector 6700 with the locking non-ratcheting mechanism in a first position or engaged state, wherein the locking mechanism comprises an axially slideable button 7000 and arm 7050 as seen in FIG. 25. Axially slideable button 7000 extends radially outward from a groove or notch 3710 in outer surface of tubular element 3700 and arm 7050 extends in an axially parallel direction within inner surface of tubular element 3700.

FIG. 25 illustrates a partial side cutaway view along the centerline of the embodiment illustrated in FIG. 24, showing the locking non-ratcheting mechanism, including axially slidable button 7000 and arm 7050, in a first position or engaged state. In the first position or engaged state, axially slidable button 7000 and arm 7050 are in a forward position such that arm 7050 engages at least one of coupler flats 2010 to lock the mechanism, preventing or limiting unwanted rotation of coupler 2000. Axially slidable button 7000 and arm 7050 are configured to be slidable in an axially rearward direction to a second position or disengaged state, wherein arm 7050 disengages coupler flats 2010, thereby allowing rotation of coupler 2000 in either the clockwise or counterclockwise direction.

Figure 1:
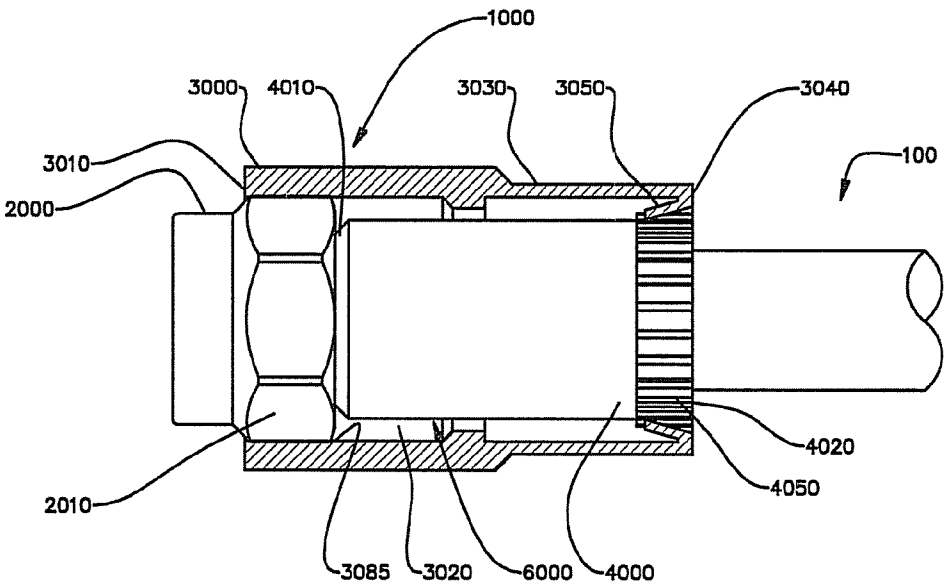
FIG. 1 illustrates a partial side cutaway view along the centerline of a locking ratcheting torque aid, as disclosed herein, comprising a ratcheting locking torque aid and connector.
Figure 26:
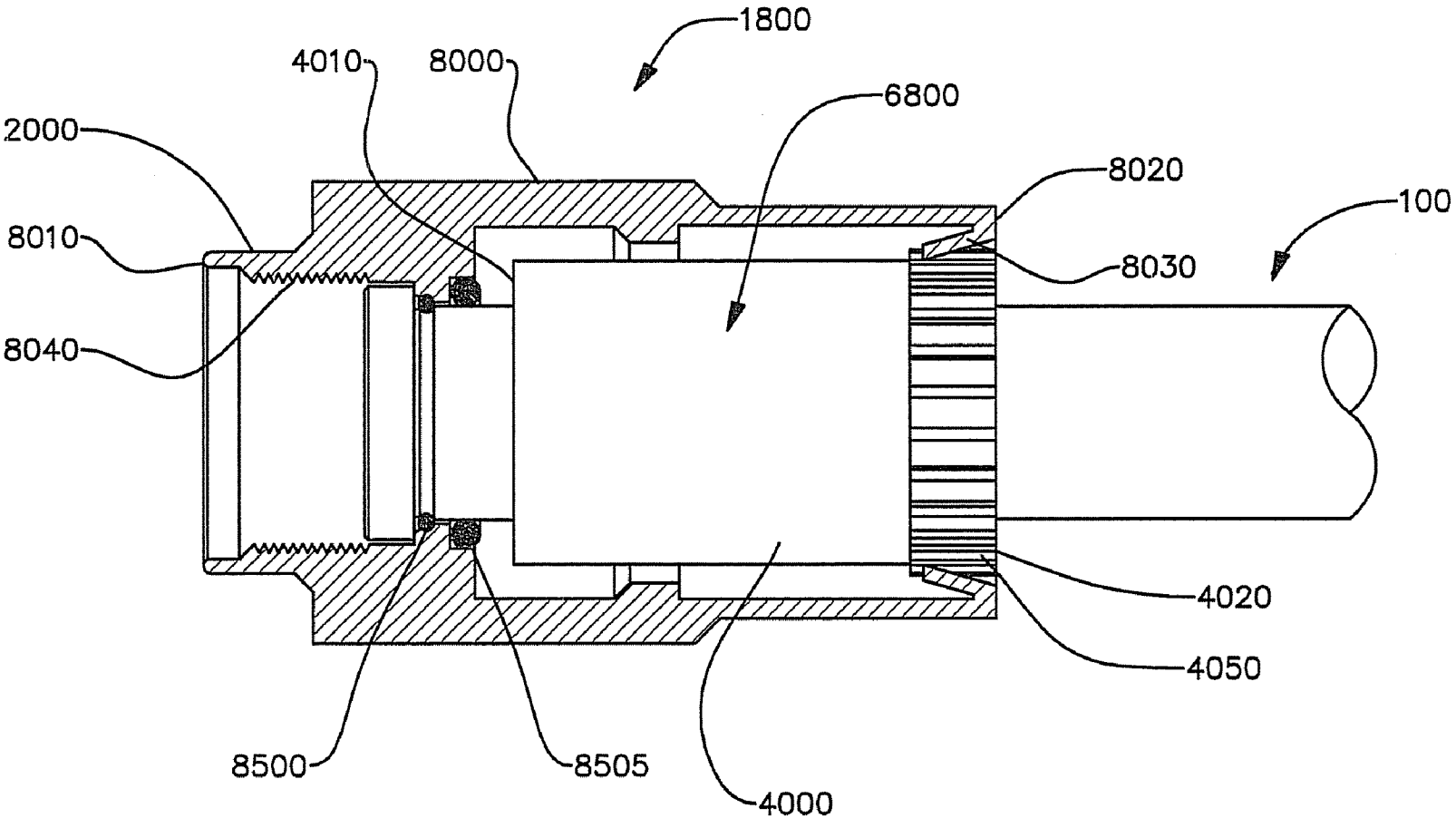
FIG. 26 illustrates a partial side cutaway view along the centerline of another alternate embodiment of a locking ratcheting torque aid, as disclosed herein, comprising a connector with the locking ratcheting mechanism in an engaged state and with the mechanism incorporated into an integral unit.

FIG. 26 illustrates a partial side cutaway view along the centerline of an alternate embodiment of a locking ratcheting torque aid 1800, as disclosed herein, showing a connector 6800 having a connector body 4000 having a front end 4010 and a back end 4020. Locking ratcheting mechanism of torque aid 1800 is illustrated in a first position or engaged state. In the embodiment illustrated in FIG. 26, what was previously coupler 2000 and tubular grip element 3000 in FIG. 1, are now combined into a single integral and unitary coupling grip element 8000. Coupling grip element 8000 has a front end 8010, a back end 8020, and an internal bore extending therethrough along an axial length thereof, wherein the front end of the coupling grip element 8000 has an internal surface 8040 that is configured to engage the outer surface of an equipment port. Locking mechanism is similar to that illustrated in FIG. 1, wherein back end 8020 of coupling grip element 8000 includes a plurality of pawls 8030 radially disposed to engage grooves 4050 that are radially spaced about body 4000 of connector 6800. In a manner similar to the embodiment illustrated in FIG. 1, locking mechanism is moveable from a first position to a second position, wherein the torque aid is configured to be placed over the connector such that when the locking mechanism is in the first position, rotation of the torque aid is inhibited in at least one direction and when the locking mechanism is in the second position, the torque aid is rotatable in either the clockwise or counterclockwise direction until the coaxial connector is fully tightened to the equipment port. Optional sealing members 8500 and 8505 are illustrated as o-rings. While FIG. 26 shows a locking mechanism that is similar to that illustrated in FIG. 1, it is to be understood that a coupling grip element that combines the functionality of a coupler and tubular grip element in a single unitary piece (as shown in FIG. 26) may be utilized with virtually any combination of alternate locking mechanism embodiments disclosed herein.

It will be apparent to those skilled in the art that various modifications and variations can be made without departing from the spirit and scope of the invention.

What is claimed is:

1. A torque aid for tightening a coaxial connector to an equipment port, the coaxial connector comprising a body having a front end and a back end, the connector also comprising a coupler rotatably attached to the front end of the body, the torque aid comprising:

a tubular grip element having a front end, a back end, and an internal bore extending therethrough along an axial length thereof, wherein the front end of the tubular grip element has an internal surface that is configured to engage the outer surface of the coupler; and a locking mechanism moveable from a first position to a second position; wherein the torque aid is configured to be placed over the connector such that:

when the locking mechanism in the first position, rotation of the torque aid and the coupling nut is inhibited in at least one direction; and when the locking mechanism is in the second position, the torque aid and the coupling nut are rotatable in either the clockwise or counterclockwise direction until the coaxial connector is fully tightened to the equipment port; and wherein the locking mechanism is movable from the first position to the second position by applying radially inward pressure on at least two opposing sides of an outer surface of said torque aid.

2. The torque aid of claim 1, wherein the torque aid is configured to be placed over the connector such that when the locking mechanism is in the second position, an engagement between the tubular grip element and the coupler drives the rotation of the coupler.

3. The torque aid of claim 1, wherein the locking mechanism comprises at least two pawls that extend radially inwardly from an internal surface of said torque aid and the application of radially inward pressure on at least two opposing sides of the outer surface of said torque aid causes radial outward movement of said at least two pawls.

4. The torque aid of claim 1, wherein the locking mechanism comprises at least two pawls that extend radially inwardly from an internal surface of said torque aid wherein, when the locking mechanism is in the first position, said at least two pawls are each configured to engage a groove on an outer surface on said body in order to inhibit the rotation of the torque aid and the coupling nut in at least one direction.

5. A torque aid for tightening a coaxial connector to an equipment port, the coaxial connector comprising a body having a front end and a back end, the connector also comprising a coupler rotatably attached to the front end of the body, the torque aid comprising:

a tubular grip element having a front end, a back end, and an internal bore extending therethrough along an axial length thereof, wherein the front end of the tubular element has an internal surface that is configured to engage the outer surface of the coupler; and a locking mechanism moveable from a first position to a second position; wherein the torque aid is configured to be placed over the connector such that:

when the locking mechanism in the first position, rotation of the torque aid and the coupling nut is inhibited in at least one direction; and when the locking mechanism is in the second position, the torque aid and the coupling nut are rotatable in either the clockwise or counterclockwise direction until the coaxial connector is fully tightened to the equipment port; and wherein the locking mechanism is moveable from the first position to the second position by moving at least a portion of the torque aid in an axial direction.

6. The torque aid of claim 5, wherein the locking mechanism comprises at least two pawls that extend radially inwardly from an internal surface of said torque aid wherein movement of said torque aid in a rearward axial direction causes said at least two pawls to pivot forward.

7. The torque aid of claim 5, wherein the locking mechanism comprises at least two pawls that extend radially inwardly from an internal surface of said torque aid wherein, when the locking mechanism is in the first position, said at least two pawls are each configured to engage a tooth on an outer surface on said body in order to inhibit the rotation of the torque aid and the coupling nut in at least one direction.

8. The torque aid of claim 5, wherein the torque aid comprises a coil spring that biases the locking mechanism in the first position.

9. The torque aid of claim 5, wherein the locking mechanism comprises an axially slidable button.

10. A combination of a coaxial connector and a torque aid for tightening the coaxial connector to an equipment port, the coaxial connector comprising:

a body having a front end and a back end; and a coupler rotatably attached to the front end of the body;

and the torque aid comprising:

a tubular grip element having a front end, a back end, and an internal bore extending therethrough along an axial length thereof, wherein the front end of the tubular grip element has an internal surface that engages the outer surface of the coupler; and a locking mechanism moveable from a first position to a second position;

wherein the torque aid is placed over the connector such that:

when the locking mechanism is in the first position, rotation of the torque aid and the coupling nut is inhibited in at least one direction; and when the locking mechanism is in the second position, the torque aid and the coupling nut are rotatable in either the clockwise or counterclockwise direction until the coaxial connector is fully tightened to the equipment port; and wherein the locking mechanism is movable from the first position to the second position by applying radially inward pressure on at least two opposing sides of an outer surface of said torque aid.

11. The combination of claim 10, wherein the torque aid is placed over the connector such that when the locking mechanism is in the second position, an engagement between the tubular grip element and the coupler drives the rotation of the coupler.

12. The combination of claim 10, wherein the locking mechanism comprises at least two pawls that extend radially inwardly from an internal surface of said torque aid and the application of radially inward pressure on at least two opposing sides of the outer surface of said torque aid causes radial outward movement of said at least two pawls.

13. The combination of claim 10, wherein the locking mechanism comprises at least two pawls that extend radially inwardly from an internal surface of said torque aid and an outer surface on said body comprises at least two grooves extending radially inwardly from said outer surface of said body, wherein, when the locking mechanism is in the first position, each of said at least two pawls engage one of said at least two grooves in order to inhibit the rotation of the torque aid and the coupling nut in at least one direction.

* * * * *